United States Patent [19]

Wunderlich

[11] Patent Number: 4,526,535

[45] Date of Patent: Jul. 2, 1985

[54] GAS BURNER FOR A COMBINED LAUNDRY APPLIANCE

[75] Inventor: Daniel F. Wunderlich, Newton, Iowa

[73] Assignee: The Maytag Company, Newton, Iowa

[21] Appl. No.: 565,733

[22] Filed: Dec. 27, 1983

[51] Int. Cl.[3] ..... F27B 7/36; F23D 13/40; D06F 29/00

[52] U.S. Cl. ..... 432/105; 68/20; 431/355

[58] Field of Search ..... 68/20; 432/105; 431/355

[56] References Cited

U.S. PATENT DOCUMENTS

| | | | |
|---|---|---|---|
| 2,054,589 | 9/1936 | Tinnerman | 126/39 |
| 2,486,315 | 10/1949 | Morris | 68/20 |
| 2,833,137 | 5/1958 | Geldhof | 68/19 |
| 2,866,273 | 12/1958 | Geldhof | 68/20 |
| 2,959,453 | 6/1960 | Kamin | 126/214 |
| 3,545,235 | 12/1970 | Menk | 68/19.2 |

*Primary Examiner*—John J. Camby

*Attorney, Agent, or Firm*—Richard L. Ward

[57] ABSTRACT

A dryer having a gas burner is provided for use in a combined laundry appliance. The gas burner is mounted within a compartment located within the dryer cabinet between the bottom of the dryer drum and the top cover of the washer which has a generally triangular shape when viewed from the side of the dryer with the lower portion of the compartment being shorter in front-to-rear depth than the upper portion of the compartment. The gas burner includes a reverse turn gas pipe for conducting gas from the gas valve mounted at the rear of the compartment to the entry end of a combustion chamber.

5 Claims, 3 Drawing Figures

GAS BURNER FOR A COMBINED LAUNDRY APPLIANCE

BACKGROUND OF THE INVENTION

This invention relates generally to the field of gas fueled laundry dryers and more particularly to a gas burner arrangement for use in a stack pair combination washer/dryer. In the particular arrangement described herein the dryer is mounted on support structure above the washer with the dryer cabinetry designed to permit opening and closing of the top cover mounted washer access door. The gas burner for the dryer is configured to occupy an area of reduced front-to-rear depth within the lower portion of the dryer cabinetry.

Prior art combination laundry appliances such as Geldhof, U.S. Pat. No. 2,833,137 and Menk, U.S. Pat. No. 3,545,235 issued on May 6, 1958 and on Dec. 8, 1970 respectively, have shown a dryer mounted directly to the top of a washer in a rearwardly spaced and slightly elevated posture for allowing the top cover mounted washer access door to be pivotally opened for access to the washer interior. In both of these arrangements, the electric resistance heat source for the dryer is located at the rear of the dryer unit with the compartment or space formed between the bottom of the dryer and the top of the washer used only for portions of the air circulation ductwork and, in Geldhof U.S. Pat. No. 2,833,127, for housing various controls. While it is recognized that gas fueled laundry dryers are common, there has not been shown a stack pair combination washer/dryer embodiment where the dryer includes a gas burner.

In the field of gas fueled stoves or ranges, U.S. Pat. No. 2,054,589 issued to Tinnerman on Sept. 15, 1936, teaches a stove having a row of gas burners extending across the rear of the cabinet top. Each of the burners are fed by a tube or pipe which is bent or formed in approximately a 180° bend.

Also, in the field of gas fueled stoves, U.S. Pat. No. 2,959,453 issued to Kamin on June 7, 1960, is directed toward a ventilated recess for housing the control knobs for a countertop gas cooking unit. A gas pipe extends between the gas valve and the gas burner and is formed to provide substantially a 180° bend in the gas flow path between the gas valve and the gas burner.

There has thus been shown a combined washer/dryer laundry unit with a compartment located below the bottom of the dryer and the top of the washer. Also, there have been shown gas burner arrangements for stoves with the gas burners formed at approximately 180° to convey gas from the gas valve to the gas burner. However, there has been no known showing of a dryer mounted on support structure above a washer and having a compartment of reduced front-to-rear depth formed below the dryer and capable of accommodating a gas burner.

SUMMARY OF THE INVENTION

It is therefore an object of the instant invention to provide an improved gas burner assembly for a stack laundry dryer.

It is a further object of the instant invention to provide an improved gas burner assembly having a reverse turn gas pipe and which is suitable for operation within a compartment having a reduced depth component mounting space.

Briefly, the instant invention achieves these objects in the dryer of a combined laundry appliance with a gas burner which is adapted to be operably mounted in a cabinet area of reduced front-to-rear depth with respect to the remainder of the dryer cabinet. A compartment for housing the gas burner is defined by the lower portion of the dryer cabinet which includes a front wall portion extending downward and rearward from the vertical plane of the front of the dryer to the bottom wall of the dryer so that the lower portion of the compartment is substantially shortened in front-to-rear depth. A combustion chamber provides an area for burning gas to heat air to be conducted into the dryer. A gas valve is mounted generally adjacent the rear wall of the compartment and is operable for providing gas to the gas burner. A generally C-shaped gas burner is provided which has an elongated lower leg portion extending forwardly and upwardly within the compartment from the gas valve. The C-shaped gas burner further includes an upper leg portion arcuately formed to substantially double back on the lower leg portion for directing the flow of gas from the gas valve into the combustion chamber spaced above the gas valve. The flow of gas is thus reversed from the gas valve outlet to the combustion area permitting the gas burner to be located in the compartment of reduced front-to-rear depth.

Further objects and advantages of the dryer and gas burner will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views wherein.

DESCRIPTION OF A PREFERRED EMBODIMENT

Figure 1:
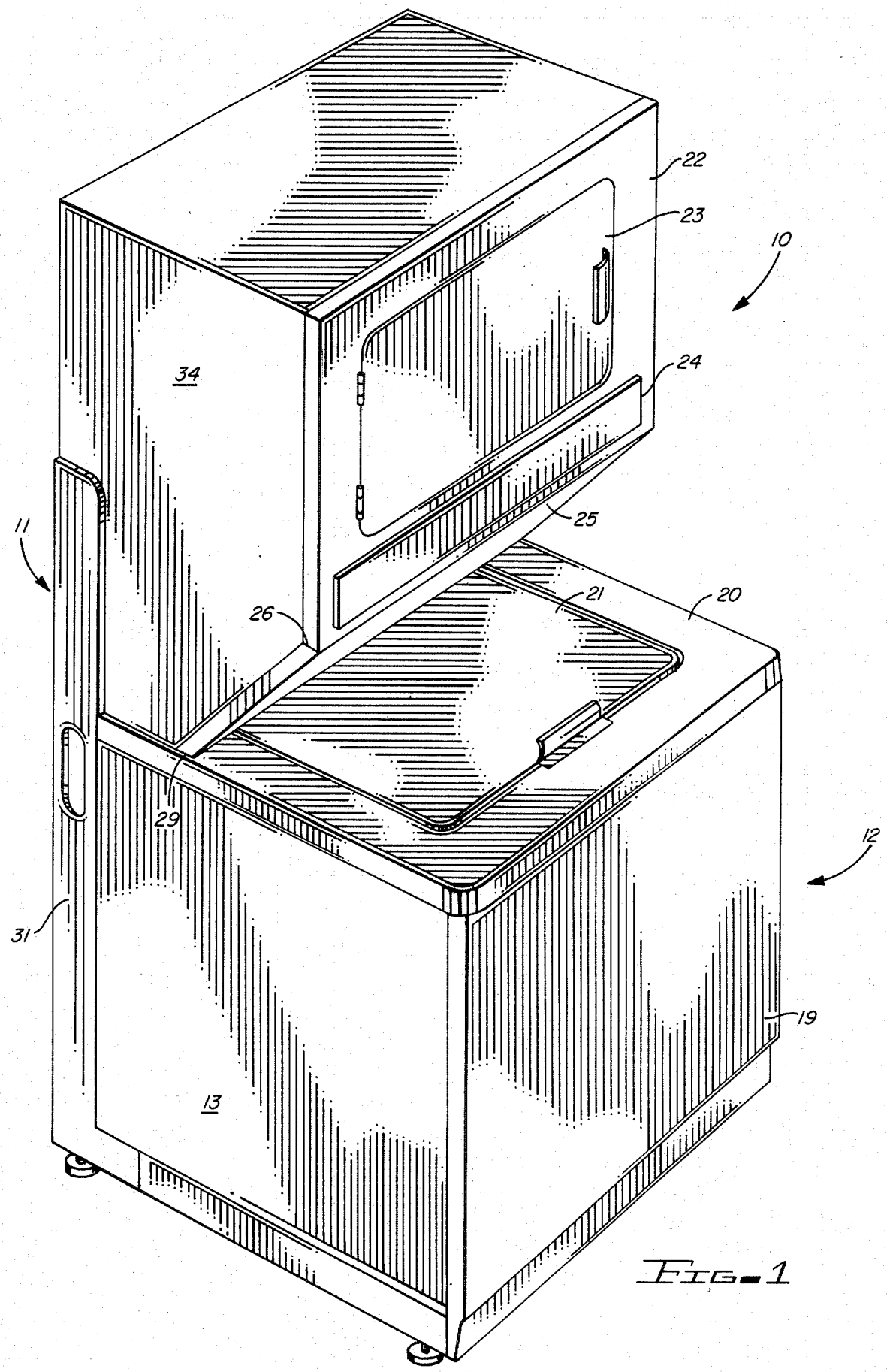
FIG. 1 is an isometric view of a washer/dryer pair mounted in a stack arrangement through supporting structure.

Referring now to the drawings there is best shown in FIG. 1 a pair of laundry appliances with a fabric dryer 10 mounted on an appliance support stand 11 above an automatic washing machine 12.

Figure 3:
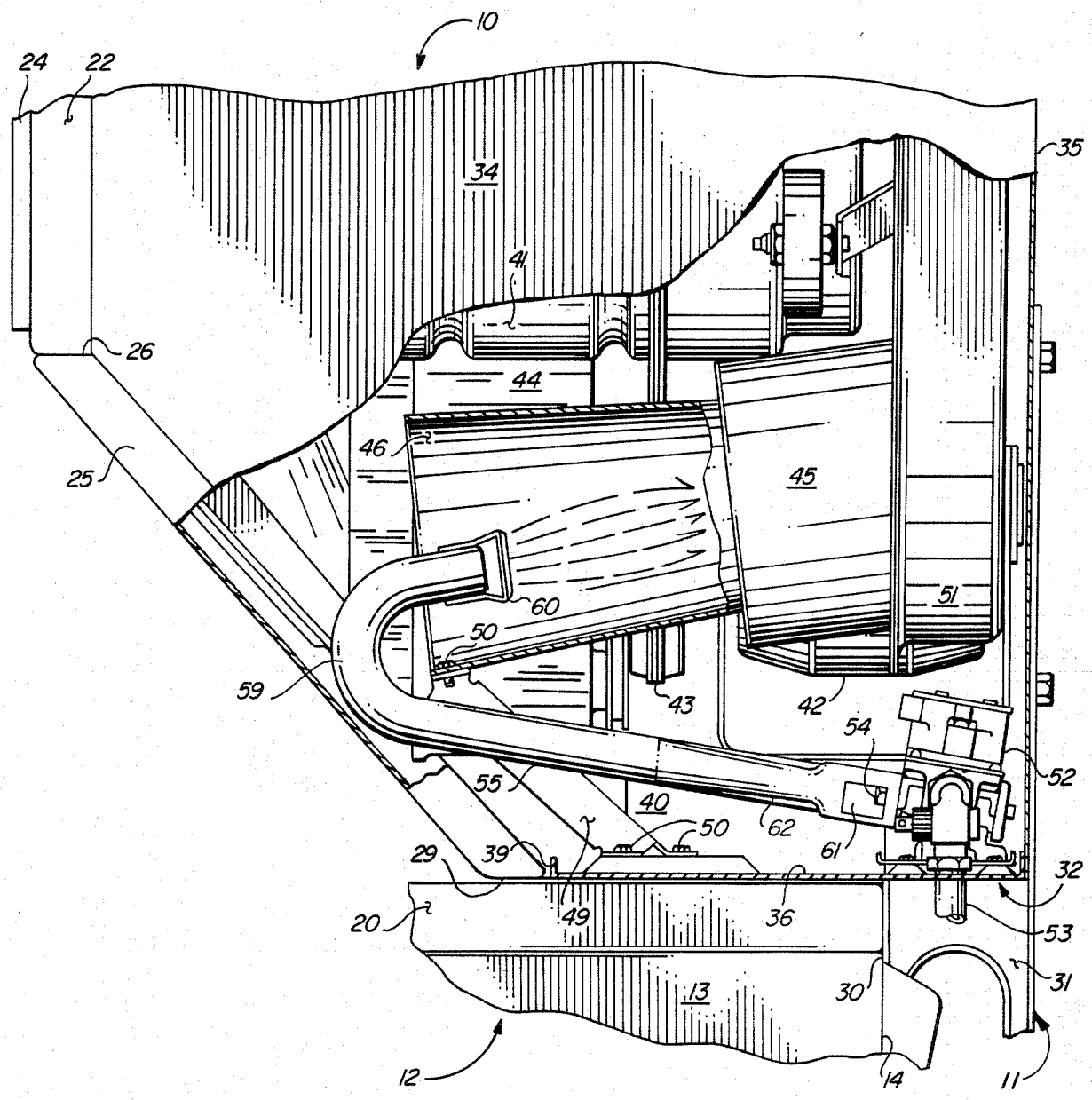
FIG. 3 is a fragmentary section view taken generally along lines 3—3 of FIG. 2.

Briefly, in this embodiment of the invention, the automatic washing machine 12 is housed within a generally rectangular cabinet having a three-sided enclosure member forming the sides 13 and rear wall 14 of the cabinet as best shown in FIGS. 1 and 3. A vertically oriented front panel 19 completes the peripheral cabinet enclosure of the washing machine 12. The cabinetry of the washing machine 12 also includes a substantially horizontal top cover 20 having a slidable access lid 21 for providing access to the interior of the washing machine 12.

The fabric dryer 10 is shown mounted in a cantilevered fashion on the support stand 11 directly above the washing machine 12 and also has a generally rectangular enclosure which is substantially shorter in front-to-rear depth than that of the washing machine 12. The vertically oriented dryer front panel 22 includes an access door 23 for loading and unloading the fabrics to be dried. Controls, such as control panel 24, may be positioned on the dryer 10 and/or washing machine 12 through which the washing machine 12 and dryer 10 are controlled. As further shown in FIGS. 1 and 3, the lower front panel 25 of the dryer 10 tapers rearwardly from a point adjacent the bottom edge 26 of the front panel 22. The lower edge 29 of the dryer lower front panel 25 is adjacent to but spaced slightly above the top cover 20 of the washing machine 12 as best shown in FIG. 3.

Figure 2:
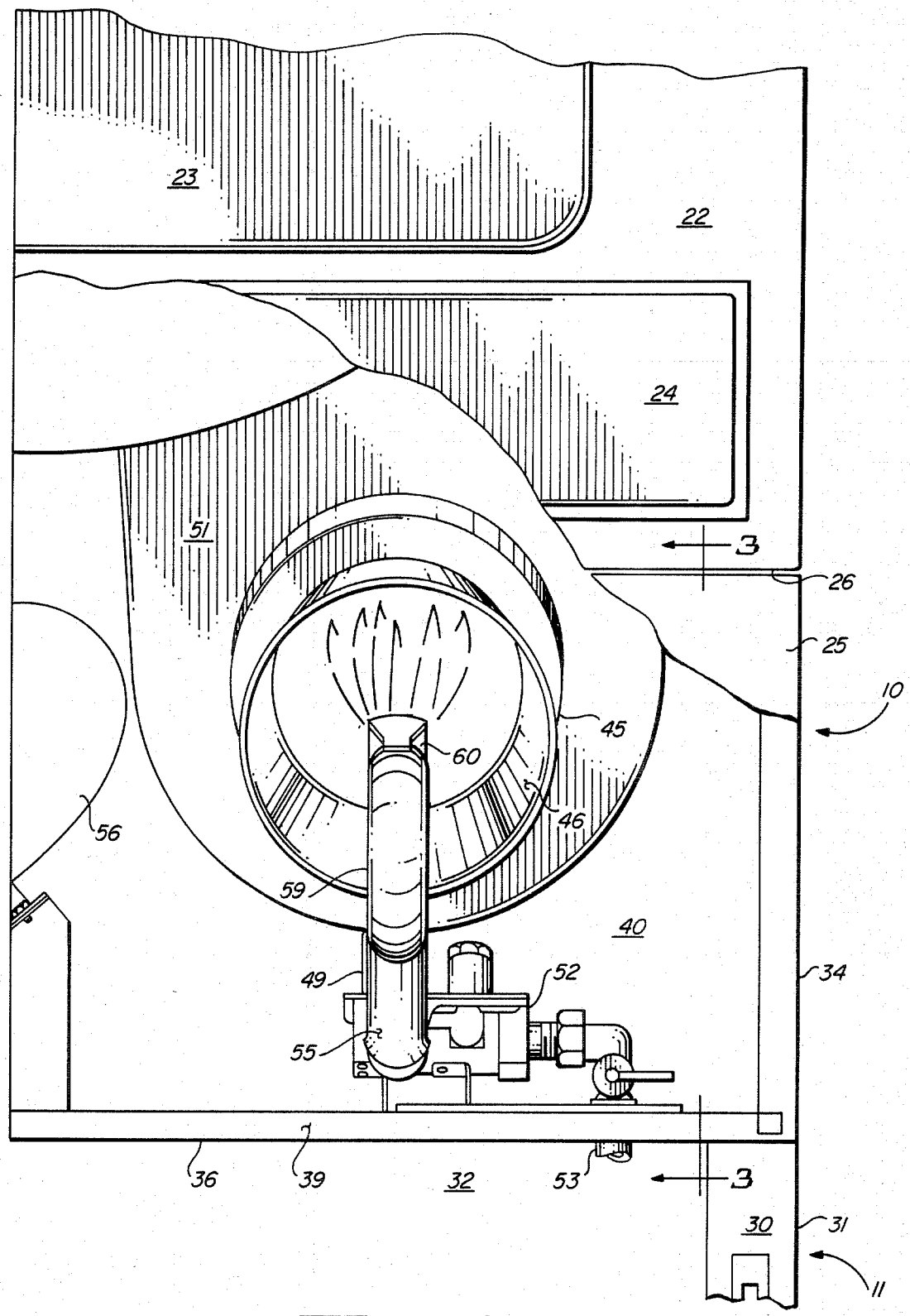
FIG. 2 is a partial view of the right front of the dryer with the lower panel removed to show the gas burner.

Referring specifically to FIGS. 2 and 3, as previously discussed, the dryer 10 is mounted slightly above the top cover 20 of the washing machine 12 on the support stand 11. As best shown in FIG. 3, when in an operable posture the rear wall 14 of the washing machine 12 is engageable with the front walls 30 of the vertical column portions 31 of the support stand 11. With the rear wall 14 of the washing machine 12 engaged with the column portions 31, an access area 32 is formed below the dryer 10 and behind the washing machine 12 for routing of utility lines such as gas, water, and electricity to the washing machine 12 and dryer 10. The access area 32 also provides an area for receiving the rear of the access lid 21 when moved to the access open position.

As further shown in FIGS. 1 and 3, the lower portion of the dryer 10 is substantially shorter in front-to-rear depth than the upper portion of the dryer 10. When viewed from the side 34, the lower portion of the dryer 10 is generally in the shape of an inverted truncated right triangle. The base of the triangle extends from the vertical plane formed by the front panel 22 toward the rear wall 35 of the dryer 10 and the rear wall 35 forms the vertical portion of the right triangle. The generally horizontal plane defined by truncating the triangle forms the bottom wall 36 of the dryer 10. As best shown in FIG. 3, the bottom wall 36 of the dryer 10 extends forward from the rear wall 35 approximately one-half the distance of the upper portion of the side 34 of the dryer 10. Beginning at the front edge 39 of the bottom wall 36, the tapering or sloping segment of the dryer 10 extends upwardly and outwardly at approximately a 48° angle with respect to the horizontal plane of the bottom wall 36. The portion of the dryer 10 located behind this sloping segment within the area of the truncated right triangle defines a lower compartment or housing 40 for mounting various components associated with the dryer 10. The frontal opening of the compartment or housing 40 is closed by means of the lower front panel 25.

As best shown in the partial section view of FIG. 3, a fabric tumbling chamber or drum 41 is rotatably mounted on a horizontal axis in generally axial alignment with the access door 23. A drive motor 42 is operable for rotating the drum 41 by means of a belt and pulley arrangement 43 as generally shown in FIG. 3. The drive motor 42 also drives a blower arrangement (not shown) mounted on the shaft of the drive motor 42 and located within the housing 44.

As further indicated in FIGS. 2 and 3, an upwardly and rearwardly sloping generally cone-shaped combustion chamber 45 is mounted on the right-hand side of the dryer 10 when facing the front of the combination washer/dryer. The entry end 46 of the combustion chamber 45 is secured to the bottom wall 36 of the dryer 10 through a mounting bracket 49 which is welded to the bottom wall 36 or secured thereto by appropriate threaded fasteners 50. The combustion chamber 45 extends angularly upward and rearward for attachment to a trough-like air duct 51 and is of sufficient length to ensure complete combustion of a gas-air mixture prior to entering the air duct 51. The air duct 51 extends upwardly for conducting heated air into the rotatable drum 41. The heated air is pulled through the drum 41, through the fabrics to be dried, and through a filter system located within the duct work prior to being exhausted to the atmosphere through the rearwardly facing exhaust duct 56.

As further shown in FIGS. 2 and 3, a gas valve 52 is mounted on the bottom wall 36 of the dryer 10 adjacent the rear wall 35 and directly above the access area 32. This mounting location permits a simple straight-in connection of the gas line 53 to the gas valve 52.

Extending forwardly and upwardly from the outlet orifice 54 of the gas valve 52 is a gas burner pipe 55. The gas burner pipe 55 is located in the area of reduced front-to-rear depth of the lower compartment or housing 40 and extends forwardly to a position juxtaposed to but not in contact with the inside wall of the lower front panel 25. In this forward position, the gas burner pipe 55 is turned back on itself in a reverse turn manner to form a substantially C-shaped end segment 59 including a flame spreader 60 and which is positioned in the entry end 46 of the combustion chamber 45. The gas burner pipe 55 includes a straight pipe segment of adequate length to provide for air inlet ports 61 and a venturi section 62 to allow mixing of gas and air between the gas valve 52 and the combustion chamber 45. The reverse turn gas burner pipe 55 is therefore operable for conducting gas from the gas valve 52 at the rear of the dryer 10 and into the entry end 46 of the combustion chamber 45 in a portion of the dryer 10 which is limited in front-to-rear depth and in a manner uncharacteristic of gas burner constructions previously used in dryers.

The gas burner assembly described herein therefore allows utilization of the reduced size generally triangular cross section compartment between the dryer drum and the top cover of the washing machine for mounting air heating apparatus in a readily accessible location with the shape of the gas burner pipe allowing construction of a combustion chamber having sufficient length to ensure complete combustion of the gas-air mixture prior to entering the air duct. This location is an improvement over positioning the heating apparatus behind the dryer unit on the rear wall as has been done in some previous combined appliances.

In the drawings and specification, there is set forth a preferred embodiment of the invention and though specific terms are employed these are used in a generic and descriptive sense only and not for purposes of limitation. Changes in the form and proportion of parts as well as the substitution of equivalents are contemplated as circumstances may suggest or render expedient without departing from the spirit or scope of the invention as defined in the following claims.

I claim:

1. The dryer of a combination stack washer/dryer with a gas burner adapted for operation in an area of reduced front-to-rear depth, the combination comprising: means defining a compartment for housing the gas burner, said compartment including a lower front wall portion disposed rearward from the vertical plane of the front of the dryer so that the lower portion of said compartment is reduced in fron-to-rear depth with respect to the top portion; means defining a combustion chamber including a body portion having an inlet juxtaposed to said front wall portion and an outlet in airflow communication with the interior of the dryer and operable for burning gas to heat air to be conducted into the dryer; gas valve means mounted within said compartment and operable for providing gas to said gas burner; and an elongated gas burner pipe including a lower leg portion extending forwardly from the outlet of said gas valve means within said compartment, said gas burner pipe further including an upper leg portion formed to substantially double back on said lower leg portion and extend rearwardly into said inlet of said combustion chamber whereby said elongated gas pipe conducts the flow of gas from said gas valve means into said combustion chamber and permits said gas burner including said elongated gas burner pipe to be located within said compartment of reduced front-to-rear depth.

2. A dryer with a gas burner as defined in claim 1 wherein said upper leg portion of said gas burner pipe is located in closely spaced juxtaposition to said front wall portion of said compartment.

3. A dryer with a gas burner as defined in claim 1 wherein said inlet of said combustion chamber generally surrounds the upper leg portion of said gas burner pipe and said outlet is in airflow communication with a duct means for conducting heated air into the dryer.

4. The dryer of a combination stack washer/dryer with a gas burner adapted to be operably mounted in an area of reduced front-to-rear depth, the combination comprising: cabinet means for housing the dryer and including a front wall portion divided into upper and lower segments with said lower segment sloping downwardly and rearwardly from the vertical plane formed by the front of said upper segment to define a compartment of substantially reduced front-to-rear depth at the bottom and located between said washer and dryer for operably mounting said gas burner; a generally upwardly extending air duct adjacent a back wall portion of said cabinet means for conducting heated air into said dryer; means defining a combustion chamber including a body portion having an outlet in airflow communication with said air duct and an inlet in spaced juxtaposition to said sloping lower segment, said body portion extending upwardly and rearwardly within said compartment and operable for burning gas to heat air to be conducted into said dryer; gas valve means mounted within said compartment adjacent said back wall portion of said cabinet means for supplying gas to said combustion chamber; and an elongated gas burner pipe extending between the outlet of said gas valve means and the inlet of said combustion chamber and having a generally upwardly and forwardly extending first portion and an arcuately shaped reverse turn second portion, the combination of said first and second gas burner pipe portions providing for directing gas flow between the outlet of said gas valve means and the inlet of said combustion chamber and permitting said gas burner including said elongated gas burner pipe to be located within said compartment of reduced front-to-rear depth.

5. A dryer with a gas burner as defined in claim 4 wherein the back wall portion of said cabinet means is spaced rearwardly from the rear of the washer and the inlet to said gas valve means is located in the space below the dryer and behind the washer.

* * * * *